United States Patent [19]

Alm

[11] Patent Number: 4,602,660

[45] Date of Patent: Jul. 29, 1986

[54] PNEUMATIC SHUTTLE PICKING MECHANISM

[75] Inventor: Pekka F. Alm, Upsala, Sweden

[73] Assignee: Hermann Wangner GmbH & Co. KG, Fed. Rep. of Germany

[21] Appl. No.: 753,388

[22] Filed: Jul. 10, 1985

[30] Foreign Application Priority Data

Jul. 18, 1984 [DE] Fed. Rep. of Germany ..... 3426534

[51] Int. Cl.[4] ..... D03D 49/26

[52] U.S. Cl. ..... 139/144

[58] Field of Search ..... 60/477, 478, 479; 91/400, 401, 402, 403, 404, 405, 406, 407; 139/144

[56] References Cited

U.S. PATENT DOCUMENTS

| | | | |
|---|---|---|---|
| 2,677,933 | 5/1954 | Hopkinson | 60/477 |
| 3,433,271 | 3/1969 | Svaty et al. | 139/144 |
| 3,902,530 | 9/1975 | Wueger | 139/144 |
| 4,082,118 | 4/1978 | Nims | 139/144 |
| 4,111,239 | 9/1978 | Svaty | 139/144 |

FOREIGN PATENT DOCUMENTS

| | | | |
|---|---|---|---|
| 380876 | 6/1940 | Italy | 139/144 |
| 288 | 5/1979 | PCT Int'l Appl. . | |
| 366006 | 1/1963 | Switzerland | 139/144 |

*Primary Examiner*—Henry S. Jaudon

*Attorney, Agent, or Firm*—John J. Torrente

[57] ABSTRACT

A pneumatic picking mechanism for weaving shuttles wherein the weaving shuttle is driven by a piston moved in a cylinder cavity by pressurized gas and wherein the pressurized gas is supplied from a reservoir through a main valve to the cylinder cavity and the main valve is controlled via a control valve assisted by an auxiliary valve.

8 Claims, 8 Drawing Figures

PNEUMATIC SHUTTLE PICKING MECHANISM

BACKGROUND OF THE INVENTION

This invention relates to a pneumatic shuttle picking mechanism and in particular, to a pneumatic picking mechanism in which a piston is moved in a cylinder by pressurized fluid and a rod attached to the piston drives a weaving shuttle.

In mechanisms of this type, the flow of the pressurized fluid from a reservoir to the cylinder is controlled by a main valve having a valve seat, a valve member and a valve guide in which the valve member is slidably mounted. An auxiliary valve actuates the main valve by establishing a pressure differential between the front and rear sides of the valve member.

Such a pneumatic shuttle picking mechanism is disclosed in U.S. Pat. No. 2,677,933. In the mechanism of the '933 Patent, the reservoir annularly surrounds the cylinder, and the valve seat is formed by the open end of the cylinder into which the forward cylindrical end of the valve member can be pushed to close the main valve. The pressure prevailing in the cylinder, and the operating pressure prevailing in the reservoir surrounding the cylinder affects the front face of the valve member. The rear face of the valve member can be subjected to high pressure by way of the auxiliary valve, which causes closure of the main valve, or to atmospheric pressure, which causes opening of the main valve.

With the main valve open, the pressurized gas in the reservoir flows into the cylinder and moves the piston which drives the shuttle by way of the piston rod. With the main valve closed, there exists a connection from the cylinder cavity to the outside through a passage in the main valve. Gas present in the cylinder cavity can thus escape as the piston is urged into its starting position by the arriving shuttle. In this way, the pneumatic picking mechanism acts also to decelerating the shuttle.

In the mechanism of the '933 patent it is a disadvantage that a relatively large part of the energy accumulated in the reservoir by the pressurized gas is required for opening the main valve. It is a further disadvantage that the piston is returned to its starting position exclusively by the kinetic energy of the arriving shuttle. No means are provided to return the piston, and with it the shuttle, to its starting position, if the piston does not reach this position solely by the kinetic energy of the shuttle.

U.S. Pat. No. 3,698,444 describes a pneumatic picking mechanism in which the piston of the mechanism drives the picking arm by way of a crank mechanism. In this case, pressurized fluid is supplied from a reservoir to a cylinder under the control of a magnetically actuated main valve. The '444 mechanism, however, requires a significant investment in mechanical components owing to the crank mechanism.

U.S. Pat. No. 4,082,118 describes a further pneumatic picking mechanism in which the pressurized fluid is provided by a second cylinder whose piston is driven by the loom main shaft. With this arrangement, however, the pressure in the shuttle driving cylinder cannot be built up rapidly enough.

It is therefore an object of the present invention to provide a pneumatic shuttle picking mechanism in which the piston can be subjected to the full pressure prevailing in the reservoir without major losses and within a very short time, and which ensures that the piston returns to its starting position.

SUMMARY OF THE INVENTION

In accordance with the principles of the present invention, the above and other objectives are realized in a pneumatic shuttle picking mechanism in which a main valve is used to control the feeding of pressurized gas from a reservoir to the cavity of the piston supporting cylinder and wherein the valve includes a valve seat, a valve guide and a valve member in the form of a slidably mounted valve disk adapted to bear against the valve seat when the main valve is in the closed position. The valve disk is provided with a valve stem slidably supported in the valve guide and the valve disk is further formed as a cup-shaped member with a hollow rear side so that the annular rim of the aforesaid rear side bears substantially fluid-tightly against the outer periphery of the valve guide to thereby form a chamber between the rear side of the valve disk and the front side of the valve guide. The volume of the latter chamber varies in accordance with the movement of the valve disk and reaches a maximum when the main valve is in a closed position.

The picking mechanism is further provided with an auxiliary valve which is slidably mounted in a through-bore of the valve stem. The auxiliary valve provides communication in its forward position, via the through-bore in the valve stem, between the chamber and the reservoir and, in its rear position, between the chamber and the cylinder cavity. Furthermore, it is arranged such that when the main valve is closed and the piston in the cylinder is in its rearward position, the valve is urged rearwardly by the piston away from the piston to thereby connect the chamber and the cylinder cavity.

A control valve is additionally provided in the mechanism for controlling the movement of the valve disk. The control valve provides coupling with a control port which is located at the transition from the valve seat to the cylinder cavity. The control port is coupled by the control valve with the reservoir to open the main valve and thereby cause striking of the shuttle, or is coupled with a source of gas under a pressure substantially lower than the operating pressure prevailing in the reservoir to close the main valve and thereby cause braking of the shuttle, or with a vacuum source to return the piston to its initial position with the main valve in its closed position.

Preferably the valve seat is made conical and the valve disk is provided with a matching conical annular region. An O-ring may be inserted into a groove in the valve seat for sealing purposes.

The auxiliary valve is preferably spindle-shaped and comprises a stem with an enlargement preferably provided with an O-ring in its middle. The O-ring bears against the inner wall of the longitudinal through-bore in the valve disk stem. Connecting openings from the chamber on the rear side of the valve disk terminate in the aforesaid longitudinal through-bore. Depending on its position, the auxiliary valve opens the path from the connecting openings rearwardly into the reservoir or forwardly into the cylinder cavity. For better guidance and for limiting the axial motion of the spindle in the through-bore, a further enlargement is provided at the rear end of the stem. This latter enlargement is provided with longitudinal bores in order to ensure communication between the connecting openings and the reservoir.

The valve guide has a central bore for guiding the hollow valve disk stem. As above indicated, the annular rim of the hollow rear side of the valve disk bears against the outer periphery of the valve guide so as to form a chamber between the valve guide and the rear side of the valve disk. The pressure prevailing in this chamber depends on the position of the auxiliary valve and contributes to the control of the main valve.

The control valve communicates with the reservoir and, through the control port, with the forward region of the valve seat, so that with the main valve closed there is still communication with the cylinder cavity. The control valve selectively connects the control port with the reservoir or with a source of pressurized gas which supplies a gas at relatively low superatmospheric pressure, the so-called braking pressure of, for example, 0.2 bar, or with a vacuum source of, for example, 0.2 bar. In addition, the reservoir is constantly connected with a source of pressurized gas for providing the so-called operating pressure, which is adjustable and may have a level of, for example, 4 bar superatmospheric.

The terms "superatmospheric" and "subatmospheric" or "vacuum" as used herein designate the pressure difference from ambient (atmospheric) pressure. The cylinder cavity is vented on the front side to the environment, so that the piston face is exposed to atmospheric pressure.

The pneumatic shuttle picking mechanism is controlled such that in the starting position of the piston the control port of the control valve is connected to the vacuum source so as to hold the piston in its starting position by the subatmospheric pressure. Thereby, the piston urges the auxiliary valve rearwardly so that subatmospheric pressure prevails at the connecting openings in the chamber, and also in the chamber itself. Hence, by this pressure differential, the main valve is held in closed position.

In order to pick the shuttle, the control valve connects the control port to the reservoir so as to expose the front side of the valve disk and the piston to operating pressure. Since this pressure is balanced through the relatively fine connecting openings, the chamber is still under vacuum, while the forward side of the valve disk is being subjected to operating pressure. As a result, the valve disk is urged rearwardly, i.e. the main valve opens and the piston is driven forwardly by the pressurized gas maintained at operating pressure. Movement of the piston thereby shoots the shuttle through the shed. Owing to its inertia the auxiliary valve does not follow or at most, partially follows the motion of the valve disk.

The front side of the valve disk is exposed to the operating pressure for only a very short moment—a fraction of a second—and the main valve opens in about 0.1 second. The pressure built up in the cylinder cavity then drives the piston forward and catapults the shuttle.

In order to be able to catch or brake the returning shuttle, the control port of the control valve is now connected to a source of braking pressure which is substantially lower than the operating pressure. This causes the main valve to close, i.e. the valve disk moves forwardly and bears against the valve seat. The auxiliary valve follows this movement, since it is subject to the same pressure differential, so that the forward end of the auxiliary valve now extends into the cylinder cavity. The chamber now reaches its maximum volume and is under operating pressure, because the openings connecting the chamber to the reservoir are open.

The level of the braking pressure is so selected that the piston can catch the arriving shuttle within the piston stroke. At the rear end of the piston stroke, the piston contacts the auxiliary valve and urges it rearwardly. Thereby, the connecting openings of the chamber are connected with the cylinder cavity, and the pressure in the chamber is lowered to braking pressure level. Since the rearwardly facing outer periphery of the valve disk is always exposed to operating pressure, the main valve is further held in its closed position.

In order to hold the piston in place after it has reached its rear end position, the control port of the control valve is connected with the vacuum source after braking has been completed. In the event that the braking process does not bring the piston to its rearward end position, it is now drawn to and held in said position by the subatmospheric pressure, since the front face of the piston is subjected to atmospheric pressure. Through the connecting openings the subatmospheric pressure or vacuum also spreads into the chamber. At this point, the operating cycle of the pneumatic picking mechanism is terminated. To begin the next operating cycle, the control port of the control valve is again connected to the reservoir.

The position to which the piston is returned by the kinetic energy of the shuttle as it is braking is not precisely defined. It depends on the friction between the shuttle and the warp yarns which is subject to variations. In general, the piston, will, therefore, be moved into its rearward end position by the vacuum applied in the last operating step. In order to have the full piston stroke available as an acceleration path for shuttle picking, means are preferably provided for carrying the shuttle along during the return motion of the piston and thus to also return it to its rear end position. For this purpose, a catch hook is provided at the tip of the piston rod. This hook is lifted in the forward end position of the piston, thereby releasing the shuttle.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 6:
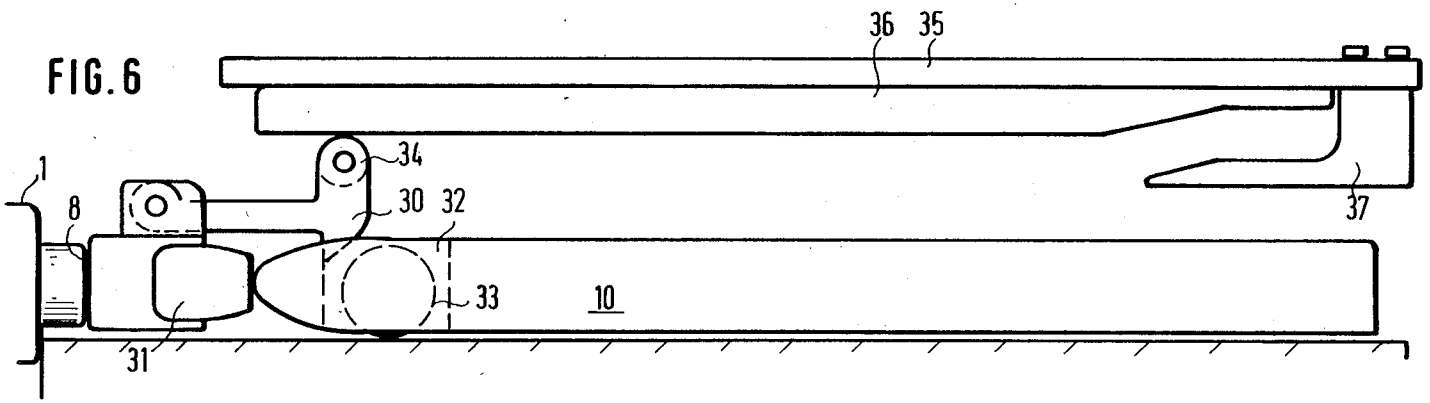
FIG. 6 shows the front end of the piston rod of the picking mechanism of FIG. 1 with a catch hook holding the shuttle.
Figure 7:
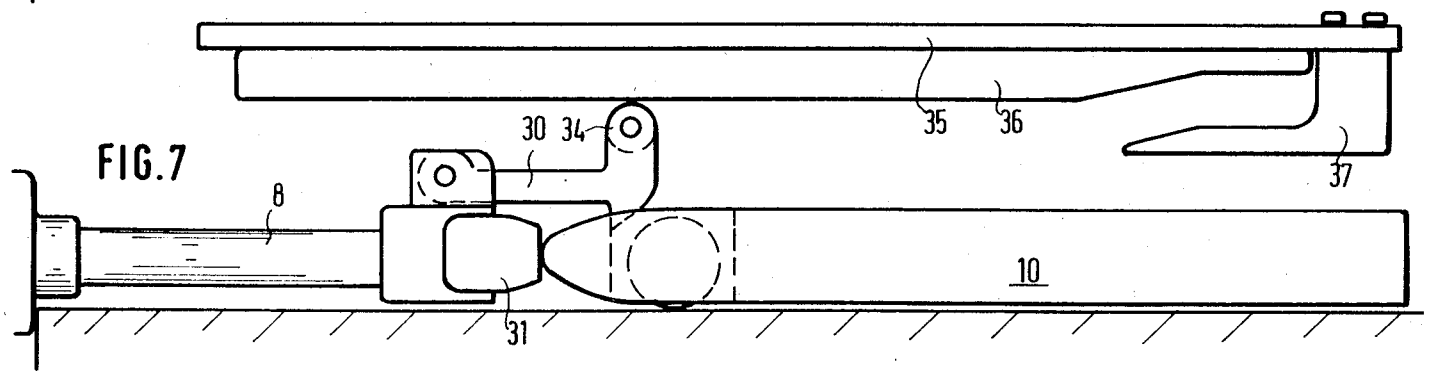
FIG. 7 shows the piston rod, catch hook, and shuttle during acceleration.
Figure 8:
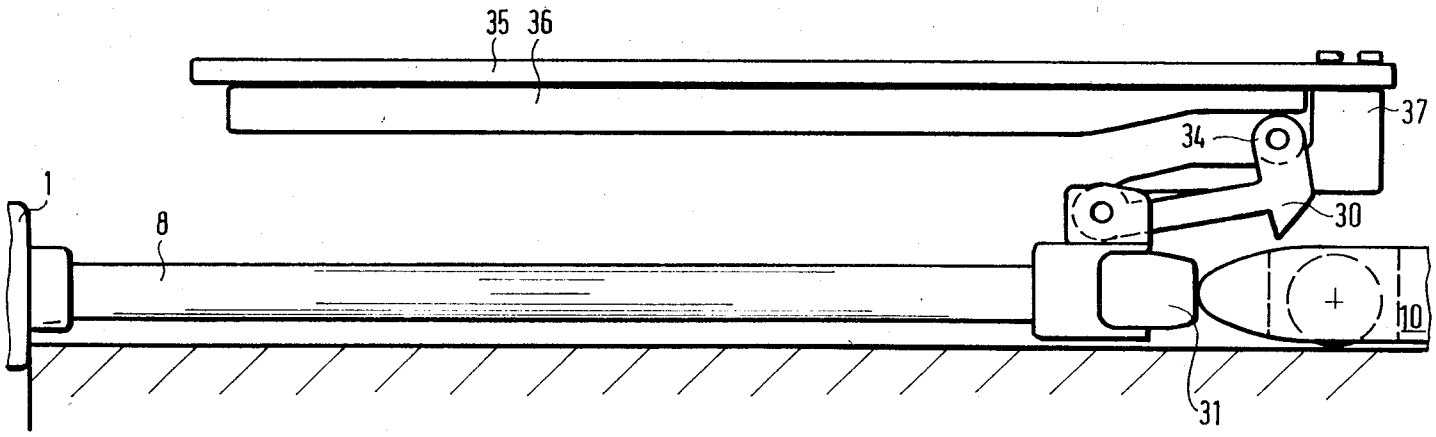
FIG. 8 shows the piston rod in its forward end position with the catch hook lifted and shuttle released.

The pneumatic shuttle picking mechanism of the invention comprises a cylinder 1, a main valve 2, a reservoir 3 for gas under operating auxiliary valve 5. The cylinder 1 defines an enclosed cavity 6 in which a piston 7 and a piston rod 8 are supported for reciprocating motion. The front end of the cylinder cavity 6 communicates with the outside through an aperture 9. A buffer 31, one embodiment of which is shown in FIGS. 6 to 8, connects the front end of the piston rod 8 to a shuttle 10.

The rear end of the cylinder 1 is directly followed by a valve seat 11 of the main valve 2. The main valve 2 further includes a valve disk 12 having a valve stem 13, an annular rim 14, and a valve guide 15. The valve guide 15 has a cylindrical surface and is arranged rearwardly of the valve seat 11 and co-axially with respect to the cylinder 1. The valve guide also has a central guide bore 16 in which the valve stem 13 is supported. The annular axially rearwardly extending rim 14 of the valve disk 12 slides on the external side of the valve guide 15 so as to form a chamber 17 between the front side of the valve guide 15 and the rear side of the valve disk 12. The chamber 17 is closed toward the outside and is provided with connecting openings pressure, an electric control valve 4, and an 18 of, for example, 2 mm diameter, which terminate only in the front region of the hollow valve stem 13.

The valve stem 13 has an axial through-bore 19 whose forward end communicates with the cylinder cavity 6 and whose rearward end communicates with the guide bore 16 of the valve guide 15. The guide bore 16, in turn, communicates with the reservoir 3. The valve disk 12 is slidably guided on the valve guide 15, and any movement of the valve disk 12 results in a change in volume of the chamber 17. With the main valve 2 closed, i.e. when the valve disk 12 bears or seats against the valve seat 11, the volume of the chamber 17 is at its maximum. With the main valve open, this volume is at its minimum which is substantially zero. The main valve 2 is followed in the rearward direction by the reservoir 3 which may comprise a cylindrical space connected to a source of pressurized gas of, for example, 4 bar superatmospheric pressure.

The through-bore 19 of the valve stem 13 slidable supports the auxiliary valve 5. The latter valve enables communication of the connecting openings 18 of the chamber 17 with either the reservoir 3 or the cylinder cavity 6. The auxiliary valve 5 is in the shape of a spindle and comprises a stem 20. The stem 20 is provided at its middle with a disk-shaped enlargement 21 which carries an O-ring which sealingly bears against the inner wall of the bore. The movement of the auxiliary valve 5 is suitably limited by stops so that the disk-shaped enlargement 21 in the forward position of the auxiliary valve is disposed before the connecting openings 18, and in the rear end position of the auxiliary valve 5 is disposed behind the connecting openings 18. In the forward position, the stem 20 extends somewhat into the cylinder cavity 6. For better guidance, the rear end of the stem 20 can also be provided with an enlargement 22. The latter includes axial passages 23 to prevent it from having any blocking effect.

Both the valve seat 11 and the valve disk 12 have rearwardly conically flaring sealing faces. Furthermore, at the side end of the valve seat 11 an O-ring 25 is provided for sealing purposes in an annular groove in the valve seat. Into the conical sealing face of the valve seat 11 there opens rearwardly of the O-ring 25 a first conduit 26 and forwardly of the O-ring 25 a second conduit 27. The first conduit 26 establishes communication between the reservoir 3 and the control valve 4, while the second conduit connects a control port 28 with the control valve 4. Both conduits 26, 27 are so arranged that their ends are not closed by the valve disk 12 even in the closed position of the main valve 2.

This can be accomplished for the conduit 26 simply by ending the conduit at the wide end of the valve seat 11. The second conduit, however, leads to the control port 28 located at the narrow end of the valve seat 11. By making the transition from the valve seat 11 to the cylinder cavity 6 somewhat rounded, even with the main valve 2 closed, the second conduit 27 communicates with the cylinder cavity 6 through the control port 28. The control valve 4 is so designed that it is able to selectively perform the following three functions: firstly, to interconnect the first conduit 26 and the second conduit 27; secondly, to close the first conduit 26 and to connect the second conduit 27 to a source of pressurized gas which provides a braking pressure of, for example, 0.2 bar superatmospheric; and thirdly, to close the first conduit 26 and to connect the second conduit with a vacuum source of, for example, 0.2 bar.

Figure 1:
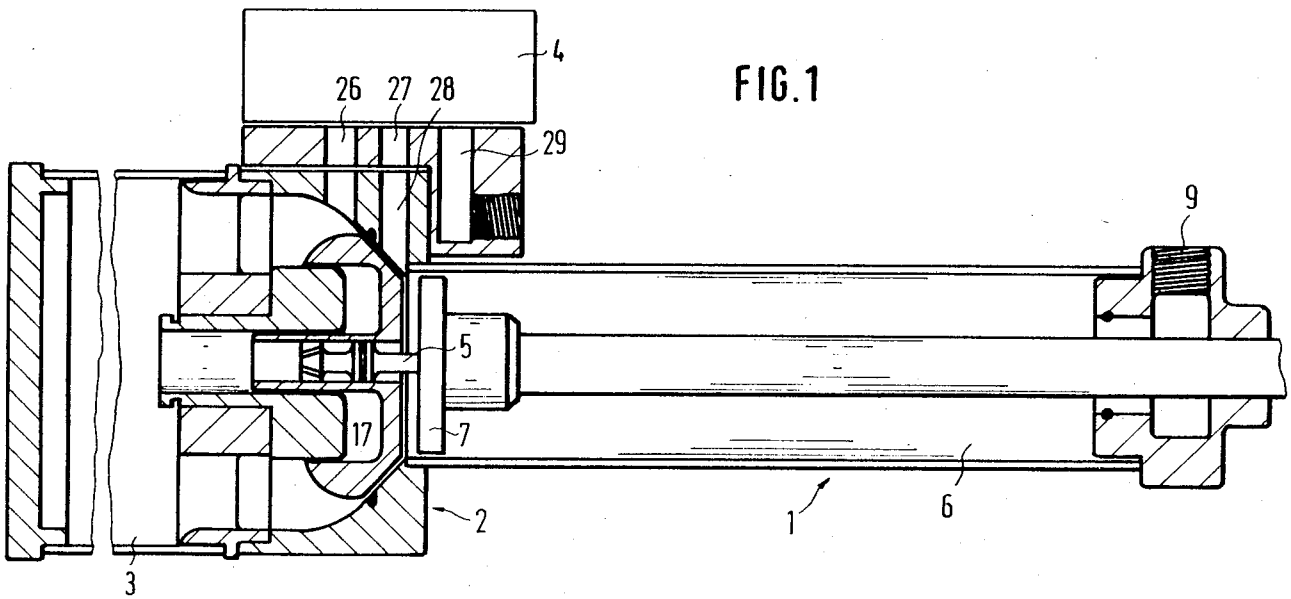
FIG. 1 shows a sectional view of the picking mechanism, in the starting position, and with its main valve closed.

The shuttle picking mechanism of the invention operates in three working steps. In the first step the main valve 2 is closed, the second conduit 27 is connected to a vacuum, and the piston 7 is in its rear starting position. This urges the auxiliary valve 5 rearwardly so that the connecting openings 18 communicate with the front side of the valve disk 12, thereby also placing the chamber 17 under vacuum. This condition of the picking mechanism is shown in FIG. 1. It is the starting position prior to striking or shooting of the shuttle.

Figure 2:
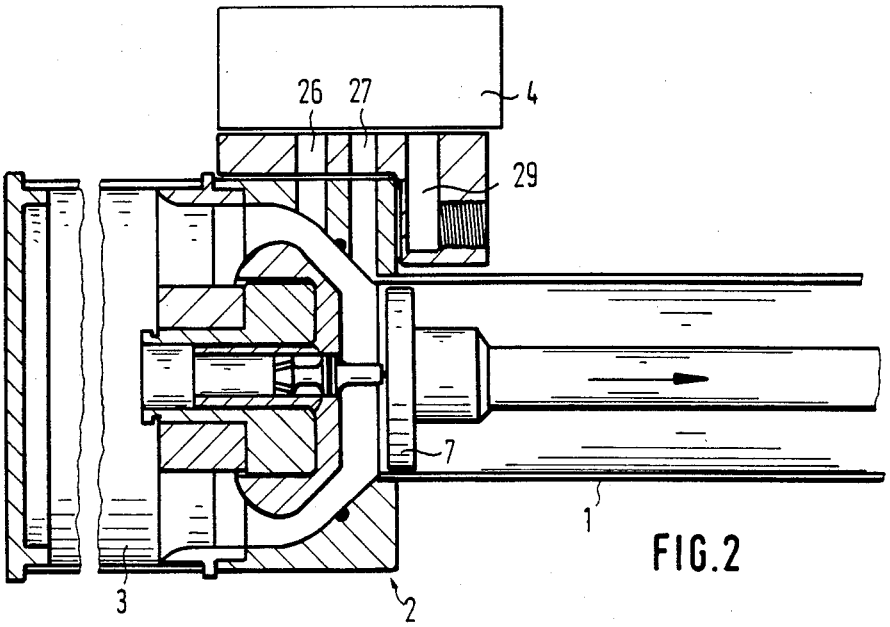
FIG. 2 shows in sectional view, the picking mechanism at the start of piston movement, and with its main valve open.
Figure 4:
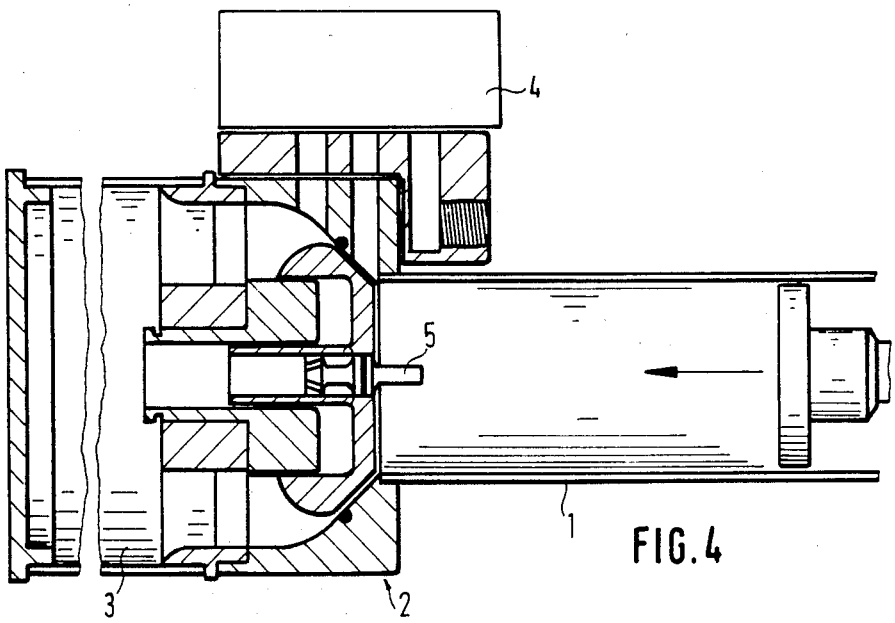
FIG. 4 shows in sectional view the picking mechanism during braking and with its main valve closed.

In the second working step the control valve 4 connects the first conduit 26 with the second conduit 27 for a fraction of a second, e.g. 0.05 sec., so that the working pressure builds up between the valve disk 12 and the piston 7. Since the chamber 17 is still under vacuum and the operating pressure spreads through the small connecting openings 18 into the chamber 17 very slowly, the pressure at the rear face of the valve disk 12, namely that in the chamber 17, is lower than that at the front face of the valve disk 12. The valve disk is thus shifted rearwardly (to the left in FIG. 2), whereby the disk is lifted off the valve seat 11, opening the main valve 2. As a result, the chamber 17 disappears, i.e. its volume becomes substantially zero. This condition of the picking mechanism is shown in FIG. 2. Due to the opened main valve, pressurized gas can now flow rapidly through the annular space formed between valve seat 11 and valve disk 12 into the cylinder cavity 6. The piston is thereby driven forward to pick the shuttle 10. Owing to the operating pressure gradually building up in the chamber 17, the valve disk 12 moves forward only slowly. Within the short time of shuttle picking there is thus no appreciable reduction in flow cross section between the valve seat 11 and the valve disk 12. This also applies to the embodiment of the invention described in FIG. 5 in which the valve disk 12 is urged with a slight force into the closed position preferably by a compression spring 46. During the rearward movement of the valve disk 12, the auxiliary valve 5, owing to its inertia, changes its position only slightly or not at all, i.e. it moves forward relative to the valve disk 12.

Figure 3:
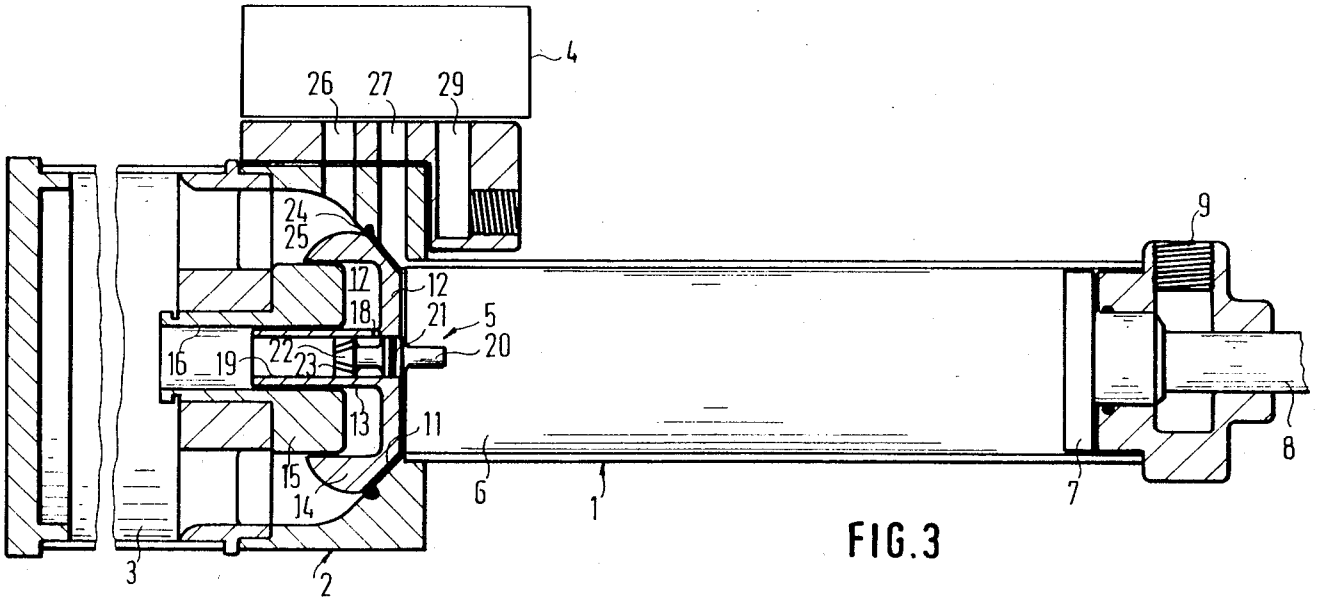
FIG. 3 shows in sectional view the picking mechanism with its piston in the forward end position and its main valve closed in preparation for the braking.

As soon as the piston 7 has reached its forward end position (to the right in FIG. 3) the third working step commences. The first conduit 26 is closed and the second conduit 27 vents the operating pressure through a conduit 29 until the desired braking pressure prevails, and is connected to a source of pressurized gas supplying the braking pressure, which pressure is relatively low and may be, for example, 0.2 bar above atmospheric. The braking pressure is substantially lower than the operating pressure, so that the front face of the valve disk 12 is subject to lesser pressure than its rear face. The valve disk 12 is thus shifted towards the valve seat 11 so that the main valve 2 closes. The auxiliary valve 5 does not change its position relative to the valve disk 12, i.e. it is likewise shifted forward so that the chamber 17 is enlarged while under operating pressure. This condition of the picking mechanism is shown in FIG. 3 and, as soon as the main valve 2 is closed, the picking mechanism is able to catch and brake the returning shuttle.

The pressure cushion in the cylinder cavity 6 uniformly brakes the shuttle 10. The required braking path depends on the level of the braking pressure, on the size of the control port between the second conduit 27 and the cylinder cavity 6, and on the adustable size of the aperture 29. The braking path is selected to be as long as possible, i.e. the braking pressure is to be as low as possible so that during braking of the shuttle 10 the piston will come to a halt in the vicinity of its left-hand end position.

During the first working step of the next working cycle, the first conduit 26 again remains closed and the second conduit 27 is connected to a vacuum source supplying a vacuum of for, example, 0.2 bar. This vacuum, in turn, propagates through the control port 28 into the cylinder cavity 6 and draws the piston 7 fully into its left-hand end position or starting position, respectively, unless it has already reached it in the course of braking. In this starting position the piston 7 urges the auxiliary valve 5 rearwardly into the bore 19 of the valve stem 13, so that the connecting openings 18 are now in communication with the cylinder cavity 6. The vacuum thus also propagates into the chamber 17. As soon as the piston 7 has reached it left-hand end position, and the vacuum prevails in the chamber 17, the shuttle picking mechanism is ready for the next shuttle picking stroke.

Since in this first working step a vacuum prevails in the chamber 17, the valve disk 12 is maintained closed only due to the operating pressure acting on the annular rim 14 and the auxiliary valve 5. Therefore, the annular rim 14 should have sufficient surface area to ensure that the disk is kept closed. The actual effective area of the rim corresponds to the difference between the diameters of the O-ring 25 and the valve guide 15. The O-ring 25 may have a diameter of for example, 8.5 cm, the valve guide 15 a diameter of 6.3 cm, and the auxiliary valve 5 a diameter of 2 cm. The effective surface area is thus about 29 $cm^2$, so that at an operating pressure of 4 bar the closing force corresponds to about 1200N.

The control valve 4 is activated by a transmitter included in the program unit at the loom shaft. For individual picking operations, manual actuation is also contemplated. Between the control valve 4 and the vacuum source, a negative pressure valve is provided. This valve is actuated by the position transmitter of the shuttle box. Furthermore, between control valve 4 and the source providing the braking pressure there is provided a braking valve which is likewise activated by the position transmitter of the shuttle box. Since the timed sequence of programming the control valve, the negative pressure valve, and the braking valve is so selected that the pneumatic shuttle picking mechanism shoots off the shuttle at substantially the same instant as a mechanical picking drive, it is familiar to those of skill in the art and need not be described in detailed herein.

In order to attain a high degree of acceleration of the shuttle 10 by the piston 7 it is important to allow the pressurized gas contained in the reservoir 3 to flow substantially unimpeded into the cylinder cavity 6 and thereby to subject the piston 7 to the full operating pressure. To this end, the main valve 2 should have a very short length of construction, and the surface area of the annular chamber formed between valve seat 11 and valve disk 12 in open condition of the main valve 2 should be sufficiently large to minimize the flow resistance. At the same time gas should be able to flow from the reservoir 3 to the cylinder cavity 6 without any major directional change. These requirements can best be met if the cone angle of the valve seat 11 and of the valve disk 12 ranges between 30 degrees and 45 degrees. With a smaller angle the valve disk 12 must travel an excessively long path to open up a sufficiently large annular chamber for pressurized gas flow. At a wider angle pressure losses occur due to the two changes in the direction of flow of pressurized gas into the cylinder cavity 6.

Figure 5:
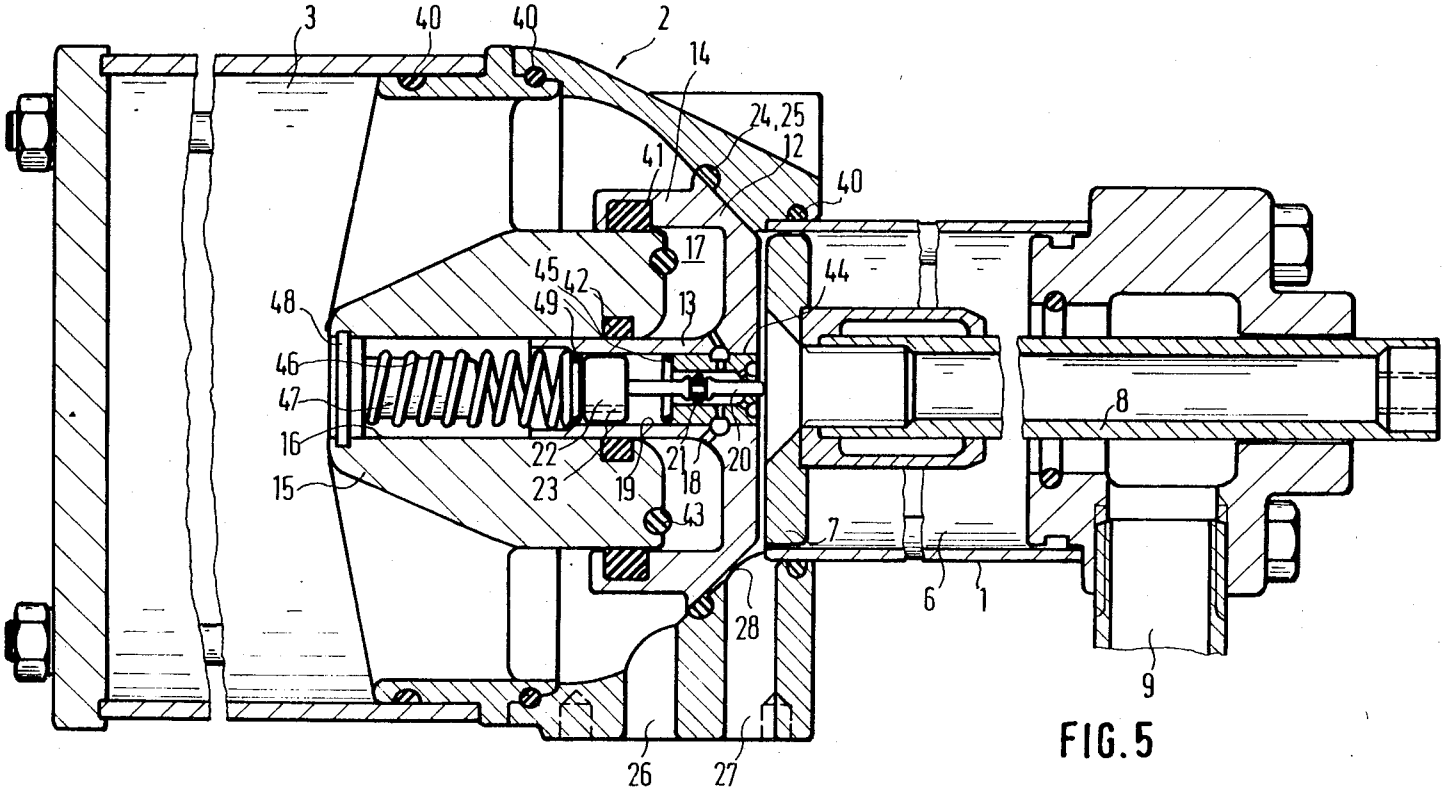
FIG. 5 shows a detailed section through the picking mechanism.

FIG. 5 shows the details of a preferred embodiment of the invention. At the junctions of cylinder 1, main valve 2, and reservoir 3, O-rings 40 are provided for sealing purposes. In the interior of the annular rim 14, a collar 41, and in the guide bore 16, a collar 42 are provided to effectively seal the chamber 17 against the reservoir 3. In the front face of the valve guide 15 an O-ring 43 is seated in a groove to cushion the impact of the valve disk 12 against the valve guide 15. The auxiliary valve 5 is guided in an annular insert 44 whose inner diameter corresponds to the enlargement 21 of the auxiliary valve 5, and which tapers in front to the diameter of the stem 20 to guide the latter. In the tapering portion of the insert 44, bores are provided to avoid obstruction of the connection between the chamber 17 and the cylinder cavity 6 when the auxiliary valve 5 is in its rearward position.

The rear end of the stem 20 has an enlargement 22 which slides in the bore 19 and which has axial passages 23. The forward end position of the auxiliary valve 5 is defined by the abutment of the enlargement 22 against the insert 44 where an O-ring 45 is interposed to cushion the impact. A compression spring 46 is seated against a rearwardly opening stepped enlargement of the diameter of the bore 19 in the valve stem 13. The other end of the compression spring 46 is seated on a guide pin 47 mounted by a spring ring 48 at the rear end of the guide bore 16.

The compression spring 46 is not essential to the function of the picking mechanism—it merely facilitates operation of the assembly and defines the position of the valve disk 12 in non-pressurized condition. In the embodiment of FIG. 5, the front end of the compression spring 46 also serves as an abutment to define the rear end position of the auxiliary valve 5. To this end an O-ring 49 is interposed between the enlargement 22 and the compression spring 46.

FIGS. 6 to 8 show a device by which the forward end of the piston rod 8 is fixedly connected to the shuttle 10 as long as the piston 7 is not in its forward end position. This enables the piston 7, in the first working step when the piston is drawn rearwardly by the vacuum prevailing in the cylinder cavity 6, to take along the shuttle 10. This connecting device comprises a catch hook 30 mounted at the forward end of the piston rod 8. Furthermore, the forward end of the piston rod 8 carries a buffer 31 engaging the shuttle 10.

The catch hook 30 is linked to the piston rod somewhat above the buffer 31 and engages a recess 32 in the shuttle which accommodates the shuttle rollers 33. The leading end of the catch hook 30 enters the recess 32 with its lower position and is provided in its upper position with a roller 34. The roller 34 slides along a rail 35 arranged parallel to and spaced above the shuttle path. The rail 35 has a rubber covering 36 along which the roller 34 slides so that the catch hook 30 is elastically urged downwardly and cannot fall out of the recess 32 in the shuttle 10.

In the forward end position of the picking mechanism, the catch hook 30 must release the shuttle 10 in order to enable it to carry the weft thread through the shed. Hence, in the forward end position the catch hook 30 must be lifted. This is accomplished by a control cam 37 which reaches underneath the sliding roller 34 and forces the sliding roller into a higher path to thereby lift the catch hook 30.

By means of the catch hook 30 the tip of the piston rod 8 and the shuttle 10, except in the forward end region, are firmly connected during the entire piston stroke. In this way, it is possible by retraction of the piston 7 to also return the shuttle 10 to the rear starting position for shuttle picking.

An advantage of the pneumatic shuttle picking mechanism of the invention is that it creates relatively low noise. While in a loom for weaving paper-machine screens with mechanical shuttle picking the noise level is about 90 dB(A), it can be reduced to about 82 dB(A), by the use of pneumatic shuttle picking of the invention.

In all cases, it is understood that the above-described arrangements are merely illustrative of the many possible specific embodiments which represent applications of the present invention. Numerous and varied other arrangements can be readily devised without departing from the spirit and scope of the invention.

What is claimed is:

1. A pneumatic shuttle picking mechanism compromising:

a cylinder defining a cavity;

a piston disposed within said cavity of said cylinder and adapted to be driven by pressurized gas;

a piston rod connected to said cylinder and adapted to be connected to a shuttle for driving the shuttle;

a main valve for controlling the feeding of pressurized gas from a reservoir to said cylinder, said main valve including: a valve seat; a valve guide; a slidably mounted valve disk adapted to bear against the valve seat when said main valve is in a closed position, said valve disk having a valve stem slidably supported in the valve guide and said valve disk being shaped like a cap with a hollow rear side, the annular rim of said hollow rear side of said valve disk bearing substantially tightly against the outer periphery of the valve guide to form between the rear side of said valve disk and the front side of said valve guide a chamber whose volume changes with movement of the valve disk and which reaches a maximum when said main valve is in the closed position;

an auxiliary valve moving said valve disk by establishing a pressure differential between the front and rear sides of said valve disk, said auxiliary valve being slidably mounted in a through-bore in said valve stem of said value disk, and in its forward position communicating said chamber through the rear opening of said through-bore with said reservoir and, in its rearward position, communicating the chamber with said cavity, the arrangement being such that, when said main valve is closed and said piston is in its rearward starting position, said auxiliary valve is urged away from said piston into its rearward position; and a control valve for providing coupling with a control port which is located at the transition from said valve seat to said cavity, said control valve connecting said control port with said reservoir to open said main valve and to strike the shuttle, or connecting said control port with a source of gas under pressure substantially lower than the operating pressure prevailing in said reservoir to close said main valve and to brake the arriving shuttle, or connecting said control port with a vacuum source to return said piston with said main valve in its closed position.

2. A shuttle picking mechanism according to claim 1 wherein:

said valve seat and said valve disk have sealing faces conically flaring toward said reservoir; and an O-ring is disposed in an annular groove formed in the wide end of the valve seat.

3. A shuttle picking mechanism according to claim 2 wherein:

said auxiliary valve includes a stem and an enlargement in the central region of said stem; and said chamber is connected to the through-bore in the valve stem of said valve disk through connecting openings.

4. A shuttle picking mechanism according to claim 1 wherein:

said auxiliary valve includes a stem and an enlargement in the central region of said stem; and said chamber is connected to the through-bore in the valve stem of said valve disk through connecting openings.

5. A shuttle picking mechanism according to claim 1 further comprising:

a catch hook mounted at the forward end of said piston rod for coupling a shuttle to the forward end of said piston rod, said catch hook being adapted to be lifted by a control cam arranged in the region of the forward end position of said piston rod to thereby disengage the shuttle.

6. A shuttle picking mechanism according to claim 2 further comprising:

a catch hook mounted at the forward end of said piston rod for coupling a shuttle to the forward end of said piston rod, said catch hook being adapted to has lifted by a control cam arranged in the region of the forward end position of said piston rod to thereby disengage the shuttle.

7. A shuttle picking mechanism according to claim 3 further comprising:

a catch hook mounted at the forward end of said piston rod for coupling a shuttle to the forward end of said piston rod, said catch hook being adapted to has lifted by a control cam arranged in the region of the forward end position of said piston rod to thereby disengage the shuttle.

8. A shuttle picking mechanism according to claim 4 further comprising:

a catch hook mounted at the forward end of said piston rod for coupling a shuttle to the forward end of said piston rod, said catch hook being adapted to has lifted by a control cam arranged in the region of the forward end position of said piston rod to thereby disengage the shuttle.

* * * * *